US006742810B2

(12) United States Patent
Vaughan

(10) Patent No.: US 6,742,810 B2
(45) Date of Patent: Jun. 1, 2004

(54) DOCUMENT OR MANUSCRIPT COVER AND/OR HOLDER

(76) Inventor: Robert O. Vaughan, 756 Clubhouse La., Lamoille, NV (US) 89828

( * ) Notice: Subject to any disclaimer, the term of this patent is extended or adjusted under 35 U.S.C. 154(b) by 0 days.

(21) Appl. No.: 10/191,227

(22) Filed: Jul. 9, 2002

(65) Prior Publication Data

US 2004/0007867 A1 Jan. 15, 2004

(51) Int. Cl.[7] ..... B42D 3/00

(52) U.S. Cl. ..... 281/45; 229/67.1; 281/51; 402/73; 402/80 R

(58) Field of Search ..... 281/29, 44, 45, 281/51; 229/67.1, 67.3; 702/73, 80 R

(56) References Cited

U.S. PATENT DOCUMENTS

| | | | | |
|---|---|---|---|---|
| 1,175,691 | A | | 3/1916 | Blizard |
| 1,466,308 | A | | 8/1923 | Livingston |
| 2,052,623 | A | | 9/1936 | Harby |
| 2,274,909 | A | | 3/1942 | Murray |
| 4,764,159 | A | | 8/1988 | Mitsuyama |
| 4,830,268 | A | | 5/1989 | Pitts |
| 5,098,366 | A | | 3/1992 | Gressman |
| 5,256,130 | A | | 10/1993 | Kachel et al. |
| 5,433,481 | A | | 7/1995 | Corbishley |
| 5,613,791 | A | * | 3/1997 | Medenica ..... 402/4 |
| 5,626,368 | A | * | 5/1997 | St. Romain ..... 281/29 |
| 5,674,021 | A | * | 10/1997 | Hutnick ..... 402/14 |
| 5,683,111 | A | * | 11/1997 | Bass et al. ..... 281/21.1 |
| 5,727,816 | A | * | 3/1998 | Ong ..... 281/29 |
| 5,791,690 | A | * | 8/1998 | Ong ..... 281/47 |
| 5,893,585 | A | * | 4/1999 | Worthen ..... 281/45 |
| 6,158,776 | A | * | 12/2000 | Purcocks ..... 281/21.1 |
| 6,193,457 | B1 | * | 2/2001 | Pacione ..... 412/1 |
| 6,299,401 | B1 | * | 10/2001 | Pacione ..... 412/1 |

* cited by examiner

*Primary Examiner*—Monica S. Carter
(74) *Attorney, Agent, or Firm*—Joseph G. Seeber

(57) ABSTRACT

A document or manuscript cover and/or holder has an extension above the document inserted into the cover so that, if it is in a file without other documents on top, it can be read like a book without removing it from the file. Even if there are other documents filed on top of the document in the cover, the documents on top need only be rolled back because space provided between the file clips that hold the documents in the file, on the one hand, and the document to be read, on the other hand, permits the documents on top to be rolled back so that the document in the cover can be read without removing it from the file and without the other documents being in the way. This is particularly important when the document within the cover is printed on both sides of the page because it can still be read like a book.

20 Claims, 8 Drawing Sheets

DOCUMENT OR MANUSCRIPT COVER AND/OR HOLDER

TECHNICAL FIELD

The present invention generally relates to a document or manuscript cover and/or holder which provides a form more convenient, usable, time-saving and attractive than is traditionally provided for use with legal documents or documents for other professions.

BACKGROUND ART

With one type of traditional document or manuscript cover, the document or manuscript is covered front and back, and is stapled in along the left hand side. The problem with this type of cover is that the document is often clipped in at the top in file folders, and it is impossible to read it without removing it from the file clips. The problem gets further complicated when other documents or other items, such as letters, memoranda and correspondence (herein "material"), get clipped into the file on top of the covered documents. When that occurs the only way to read the document is to remove the document from the file, which involves removing all the items filed subsequently above that document, and probably replacing them later.

The other commonly used cover is one that covers the back and the top of the document or the back over the top, and down the front. When clipped into a file folder, this creates a real problem in reading the document because, when it gets clipped into a file folder at the top, it binds the top portion which often makes the top of the document unreadable unless the top margin of the document is untraditionally low. Also, if there has been a number of documents or other material filed on top of the covered document, it becomes impossible to read the covered document without removal of the material above it. The problem gets further vexing, distractive and time consuming when the document is printed on both sides, requiring either removal of the document or going through the gyrations of turning the file one way to read one side of the page, and then turning it the reverse way to read the other side of the page.

Because of these problems, covered documents, which are usually the most important, are often never filed or clipped in, leaving them loose in the file, out of order and subject to getting lost or misplaced. This problem increases in proportion to the number of covered documents and other material in the file.

The following U.S. patents are generally pertinent to the present invention, but are burdened by the disadvantages set forth above: U.S. Pat. Nos. 1,175,691; 1,466,308; 2,052,623; 2,274,909; 4,764,159; 4,830,268; 5,098,366; 5,256,130; and 5,433,481.

DISCLOSURE OF INVENTION

The present invention generally relates to a document or manuscript cover and/or holder which provide a form more convenient, usable, time-saving and attractive than is traditionally provided for use with legal documents or documents for other professions.

The cover disclosed herein resolves the foregoing problems in such a manner that the document can be put in the cover, the cover and the document can be clipped in a file folder with further documents or other material filed on top, and the document can be read like a book without removal of the document or the other material from the file folder.

There are two basic embodiments of the invention. A first embodiment comprises a cover of both the front and the back of a document. A second embodiment comprises a cover of only the back of the document. Both embodiments provide for fixing or stapling the document and the cover on the left hand side so that the document can be read like a book.

In accordance with the invention, a rear panel of the cover has an extension above the document inserted into the cover so that, if the document is in a file without other material on top, it can be read like a book without removing it from the file. Even if there is other material filed on top of the document in the cover, that material need only be rolled back because space provided between the file clips that hold the other material in the file, on the one hand, and the document in the cover and to be read, on the other hand, permits the document in the cover to be read without removing it from the file and without the other material being in the way. This is particularly important when the document within the cover is printed on both sides of the page because both sides can be read like a book.

A further advantage of the present invention resides in the fact that the covered document, which is probably an important document, can be readily found in the file since the lower portion of the document extends below all other material that may be clipped above it in the file.

Traditional covers are nine inches (9") wide, which extends the cover past the material at the sides (looking down on the document), and this often covers up filing data on the right hand edge of the file and creates space problems on the left side. The space problems on the left are where the file is primarily designed for use of material eight and one-half inches (8½") wide.

In accordance with the invention, the width of the cover and document is at the most eight and five-eighths inches (8⅝"), only one-eighth (⅛") wider than standard letter material, solving the problems just described above.

Therefore, it is an object of the present invention to provide a document or manuscript cover and/or holder which provides a form more convenient, usable, time-saving and attractive than is traditionally provided for use with legal documents or documents for other professions.

It is an additional object of the present invention to provide a document or manuscript cover and/or holder wherein the document can be put in the cover, the cover and the document can be clipped into a file folder with other material filed on top, and the document can be read like a book without removal of the document or the other material from the file folder.

It is an additional object of the present invention to provide a document or manuscript cover and/or holder which has an extension above the document inserted into the cover so that, if it is in a file without other material on top, it can be read like a book without removing it from the file.

It is an additional object of the present invention to provide a document or manuscript cover and/or holder which has an extension above the document inserted into the cover so that, if there is other material filed on top of the document in the cover, the other material need only be rolled back because space provided between the file clips that hold the other material in the file, on the one hand, and the document in the cover, on the other hand, permits the document in the cover to be read without removing it from the file and without the other material being in the way.

The above and other objects, and the nature of the invention, will be more clearly understood by reference to the following detailed description, the accompanying drawings and the appended claims.

BEST MODE FOR CARRYING OUT THE INVENTION

The invention will now be described in more detail with reference to the various figures of the drawings.

Figure 1:
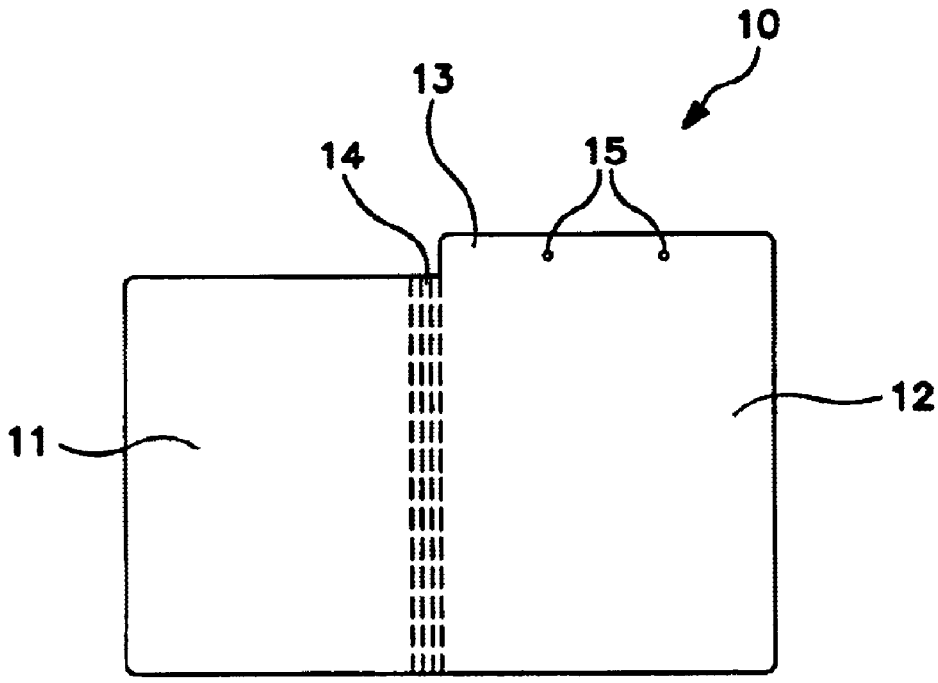
FIG. 1 depicts a first embodiment of the cover (the "back and front" cover) of the present invention in a fully open position.
Figure 2:
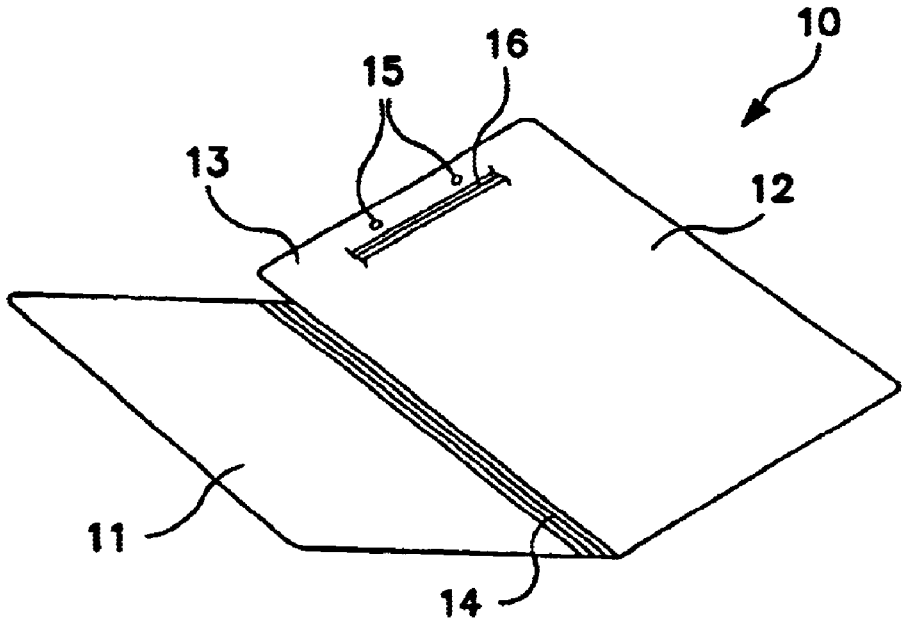
FIG. 2 depicts the cover of FIG. 1 with its front panel partially but not fully closed.

FIG. 1 depicts a first embodiment of the cover (the "back and front" cover) of the present invention in a fully open position, while FIG. 2 depicts the cover of FIG. 1 with its front panel partially but not fully closed. As seen therein, the cover 10 has a front panel 11, a rear panel 12, crease scores 14 on front panel 11, clip holes 15 on the rear panel 12, and space 16 for data to be inserted.

This first embodiment of the invention comprises a cover 10 which covers both the front and rear of a document. It has an extension 13 on top of rear panel 12, rendering rear panel 12 longer than front panel 11 by a certain amount (preferably, 1½ inches). Other preferable measurements or dimensions are shown in FIGS. 1 and 2.

Figure 3:
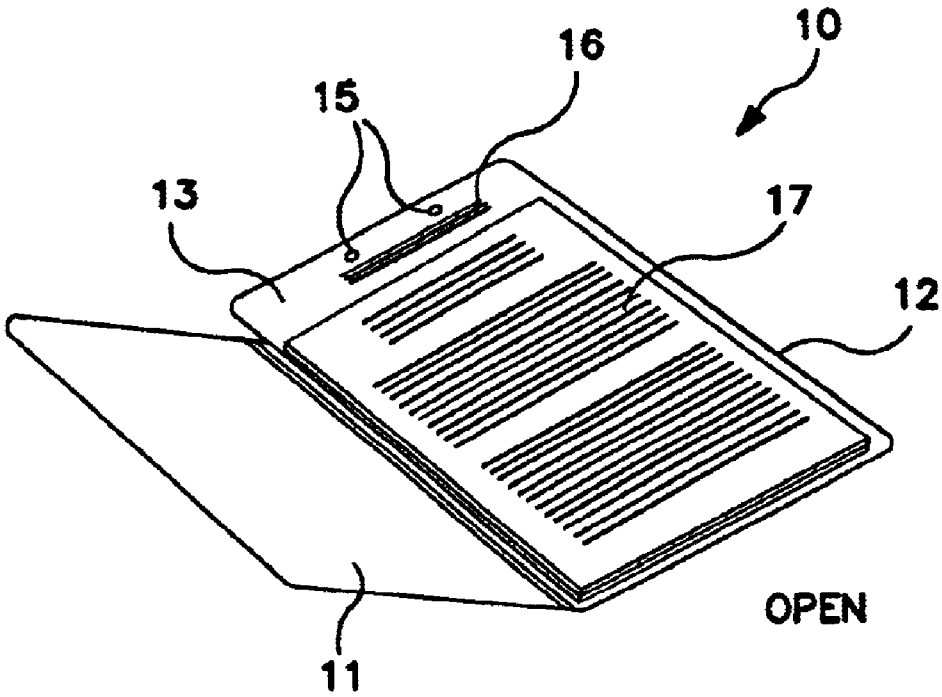
FIG. 3 depicts the cover of FIGS. 1 and 2 partially open with a document inserted but not yet stapled into it.

FIG. 3 depicts the cover of FIGS. 1 and 2 partially open with a document inserted but not yet stapled into it. Specifically, document 17 is seen inserted, but not yet fixed or stapled, into cover 10. Identifying data can be entered into space 16 provided on the extension 13. Clip holes 15 are also provided in extension 13.

Figure 4:
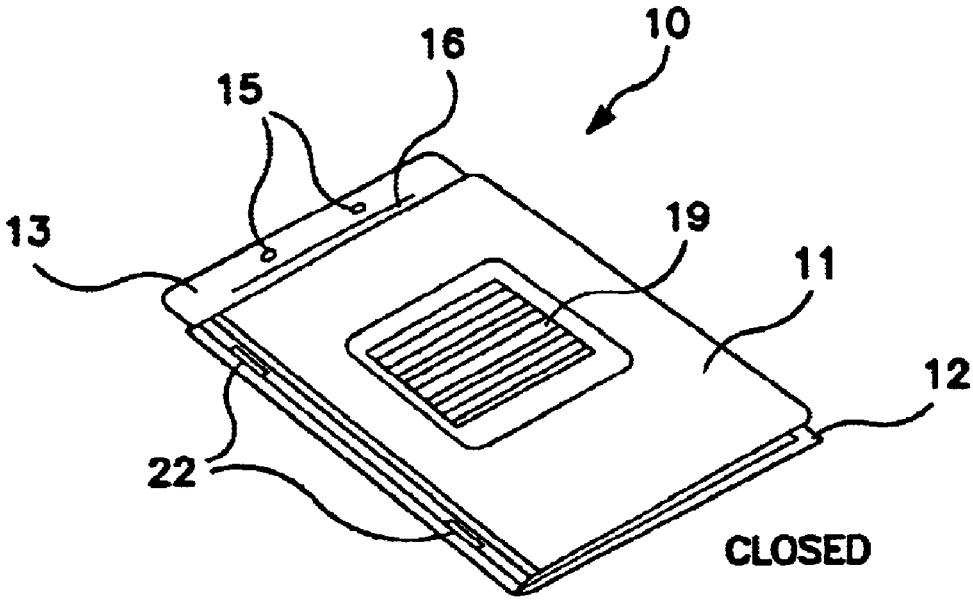
FIG. 4 depicts the cover of FIG. 3 in the closed position with the document fixed or stapled in through the front cover, through the document, and through the back cover.

FIG. 4 depicts the cover of FIG. 3 in the closed position with the document fixed or stapled in through the front panel, through the document, and through the rear panel. Specifically, document 17 is fixed or stapled into cover 10 by staples 22 inserted through the left side of front panel 11, the left side of document 17, and the left side of rear panel 12. When the cover 10 is closed, identifying data entered in space 16 on extension 13 located on the top of rear panel 12 can be seen, and other identifying data can be entered in the space 19 provided on the front panel 11.

Figure 5:
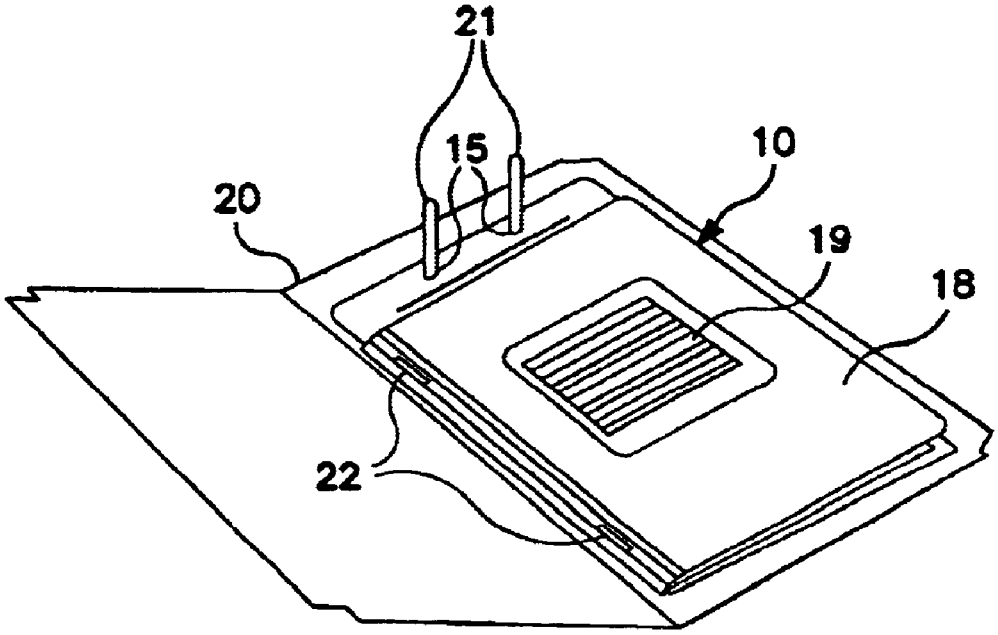
FIG. 5 depicts the cover of FIG. 4, with the document fixed or stapled into the cover, and the cover inserted into a standard file folder.

FIG. 5 depicts the cover of FIG. 4, with the document fixed or stapled into the cover, and the cover inserted into a standard file folder. File folder 20 has holes (not shown) in the upper portion of its right hand or rear panel, these holes coinciding with clip holes 15 provided in extension 13 of the rear panel of cover 10. Clips 21 are inserted through the holes in file folder 20, and the cover 10 (with document 17 stapled into it) is mounted in file folder 20 by passing clips 21 through the clip holes 15 of cover 10.

Figure 6:
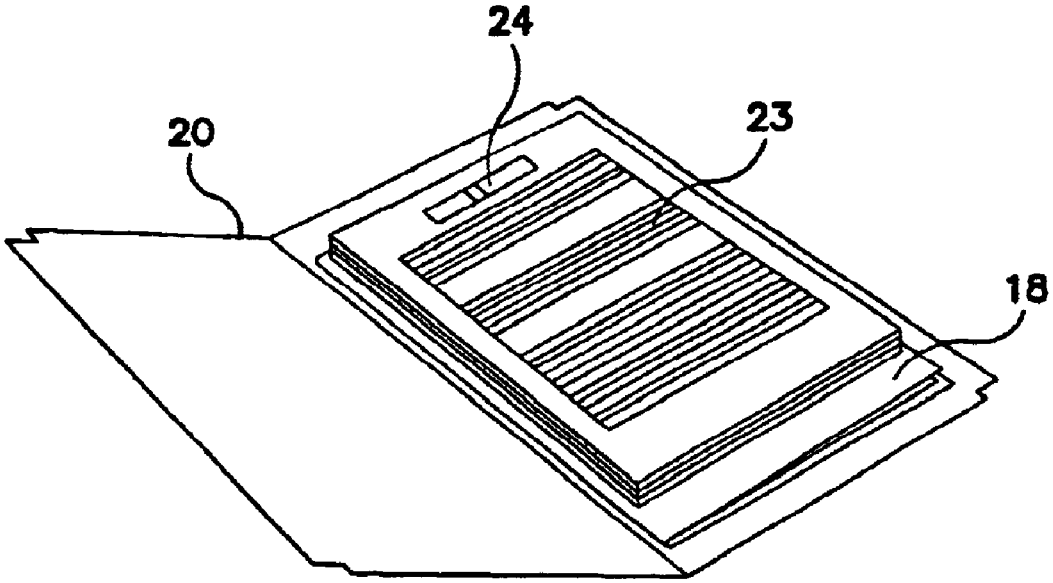
FIG. 6 depicts the file folder of FIG. 5 in the open position, with the document cover and the attached document clipped into the file folder, and with other material clipped into the folder on top of the document and cover.

FIG. 6 depicts the file folder of FIG. 5 in the open position, with the document cover and the attached document clipped into the file folder, and with other material clipped into the folder on top of the document and cover. Once the document cover 10 is positioned in file folder 20 via clips 21, additional material 23 can be secured in file folder 20 by placing it on top of cover 10. In accordance with the invention, it is assumed that the additional material 23 is previously punched so as to have holes at the top thereof, the latter holes coinciding with the clips 21. The additional material 23 is positioned in file folder 20 by passing the clips 21 through the holes in the additional material 23. Then, the cover 10 and additional material 23 are fixed in the file folder 20 by securing the clips 21 via a conventional fastener, e.g., the clasp 24 shown in FIG. 6.

Figure 7:
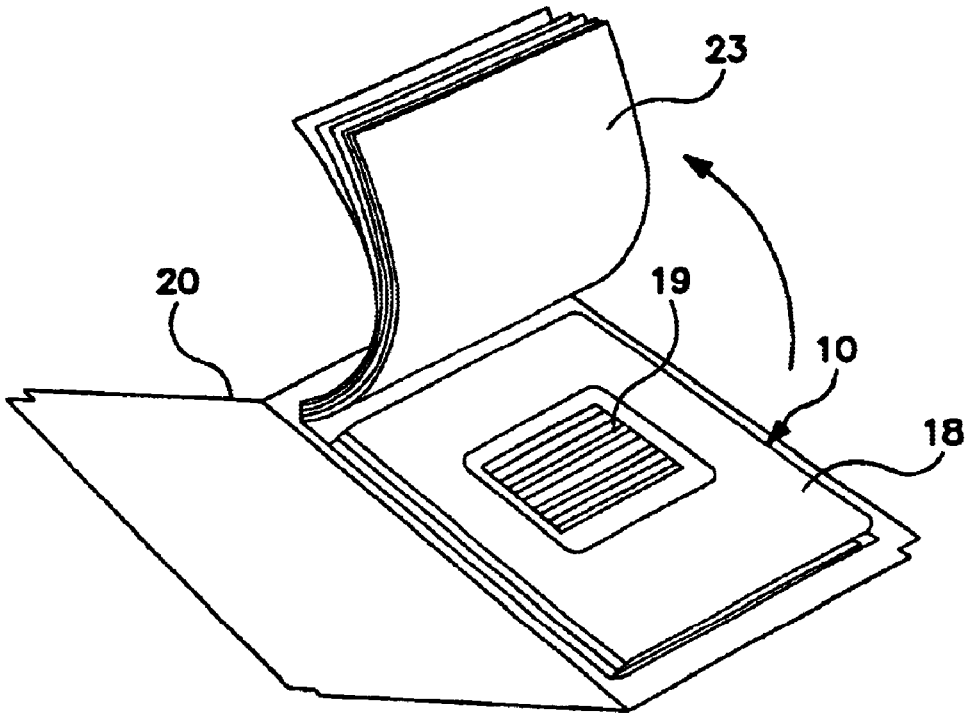
FIG. 7 depicts the file folder of FIG. 6 with the document cover and attached document clipped into it, with other material clipped on top of the document and cover, and with the other material being rolled back to expose the document in the document cover for review or reading of both the front and the back of the pages of the document.
Figure 8:
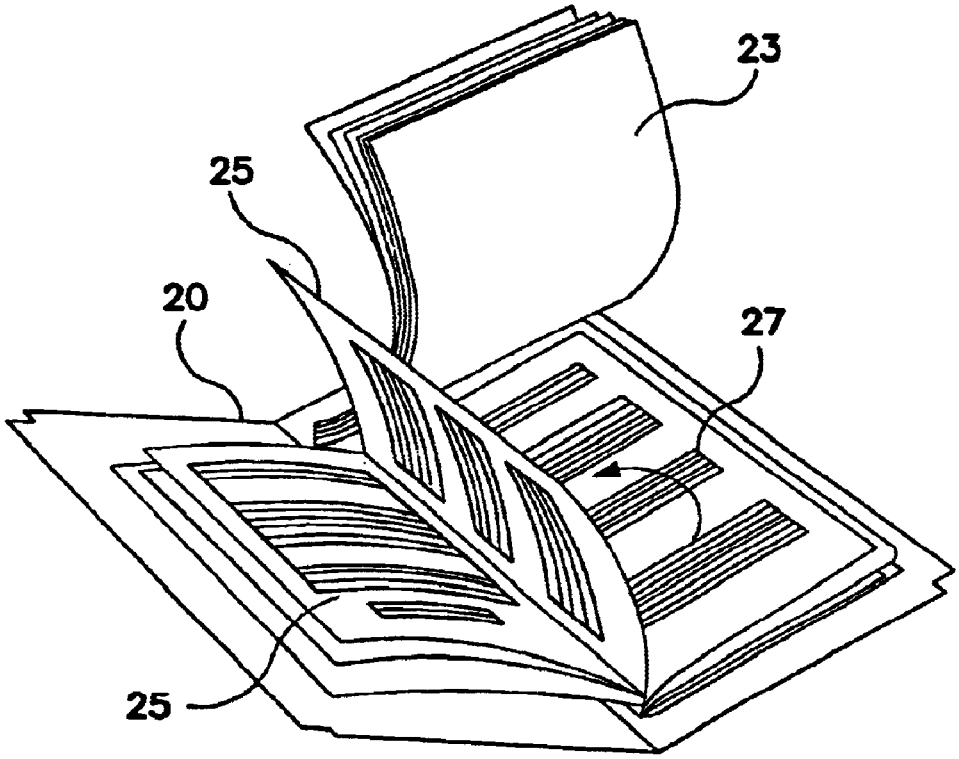
FIG. 8 depicts the file folder of FIG. 7 with the document cover and document inserted, with the other material on top rolled back, and with the pages of the document being turned in a manner similar to reading a book.

FIG. 7 depicts the file folder of FIG. 6 with the document cover and attached document clipped into it, with other material clipped on top of the document and cover, and with the other material being rolled back to expose the document in the document cover for review or reading of both the front and the back of the pages of the document, while FIG. 8 depicts the file folder of FIG. 7 with the document cover and document inserted, with the other material on top rolled back, and with the pages of the document being turned in a manner similar to reading a book. When a person desires to review the document 17 in cover 10, the additional material 23 is rolled back, the cover 10 is opened, and the document 17 is reviewed. As seen in FIG. 8, a specific page 27 of document 17 can be reviewed by turning pages 25 of document 17 in the same manner as one turns pages when reading a book. It should be noted that both the front pages and the back pages of the document 17 can be easily read.

To summarize, the cover 10 covers both the front and the back of document 17. The cover 10 has extension 13 on top so that the cover 10 and attached document 17 can be clipped into file folder 20, as depicted in FIGS. 5 and 6. If a relatively thin document (e.g., 10 to 20 pages) is inserted in cover 10, the front panel 11 and the rear panel 12 will both, preferably, be eight and five-eighths inches (8⅝") in width, only one-eighth inch (⅛") wider than a normal letter. If a thick document is placed in the cover 10, crease scores 14 located on the left hand side of the front panel 11 accommodate the thicker document as the cover 10 will recede from the right hand side.

Figure 9:
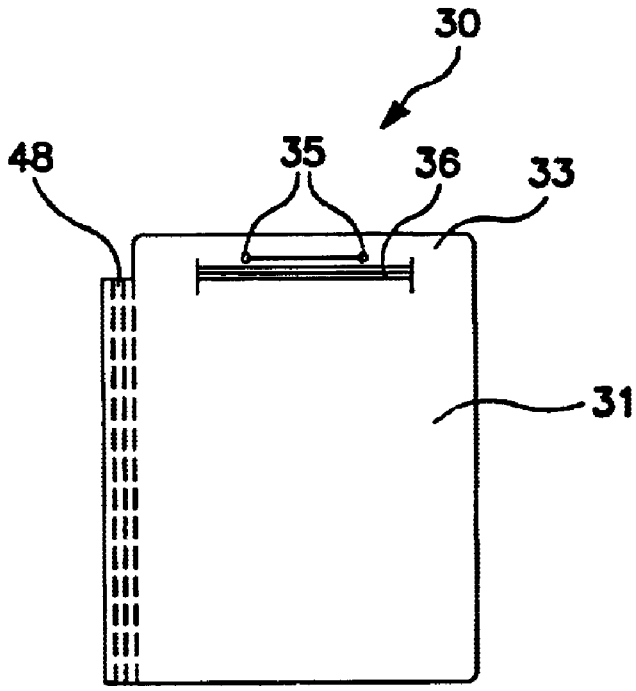
FIG. 9 depicts a second embodiment of the cover (the "back only" cover) of the present invention in a flat position.
Figure 10:
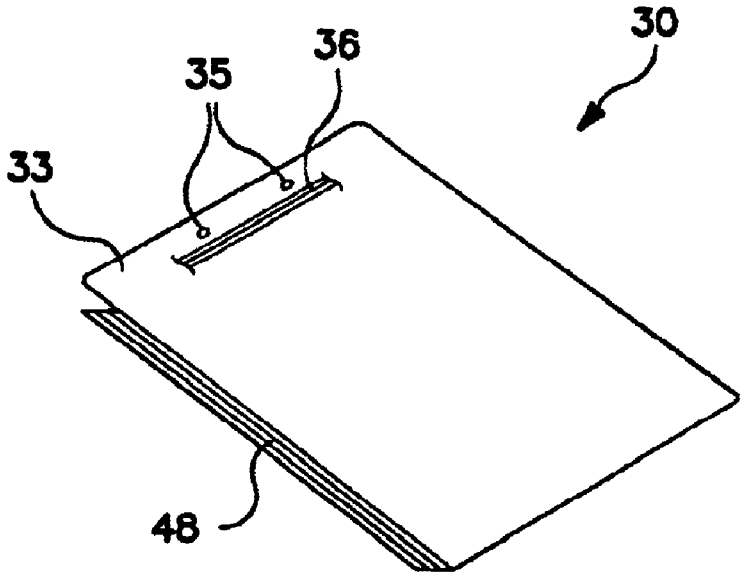
FIG. 10 depicts the cover of FIG. 9 with a creased score portion folded upward in order to cover the left side of a document to be inserted and fixed or stapled into it.

FIG. 9 depicts a second embodiment of the cover (the "back only" cover) of the present invention in a flat position, while FIG. 10 depicts the cover of FIG. 9 with a creased score portion folded upward in order to cover the left side of a document to be inserted and fixed or stapled into it. In the second embodiment of the invention, the cover 30 has a flat panel 31 which covers the rear of a document. As also seen in FIGS. 9 and 10, the panel 31 of cover 30 has a crease score portion 48 on one side (specifically, the left side), and it has an extension 33 on its top, the extension 33 having clip holes 35 and space 36 for data to be inserted. Preferable measurements or dimensions are shown in FIGS. 9 and 10.

Figure 11:
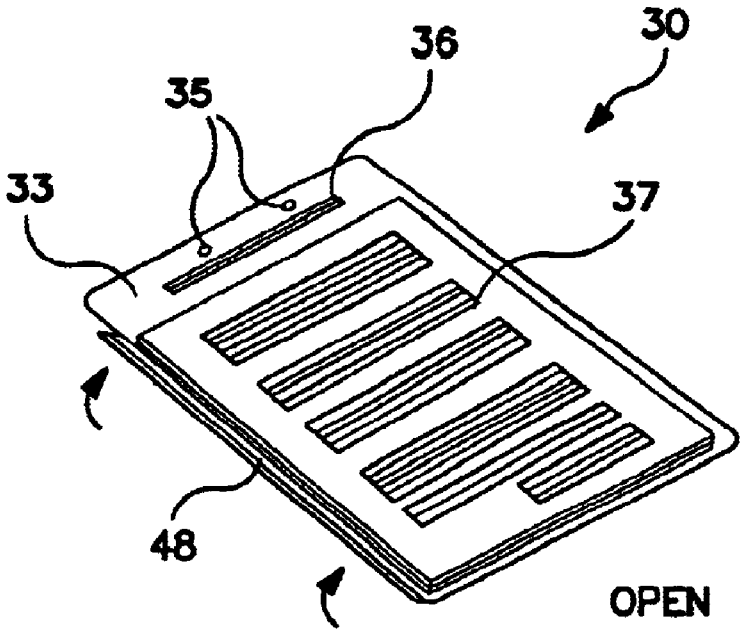
FIG. 11 depicts the cover of FIGS. 9 and 10 with a document inserted into the cover but not yet stapled into it.

FIG. 11 depicts the cover of FIGS. 9 and 10 with a document inserted into the cover but not yet stapled into it. Specifically, document 37 is seen inserted, but not yet fixed or stapled, into cover 30. Identifying data can be entered into space 36 provided on the extension 33.

Figure 12:
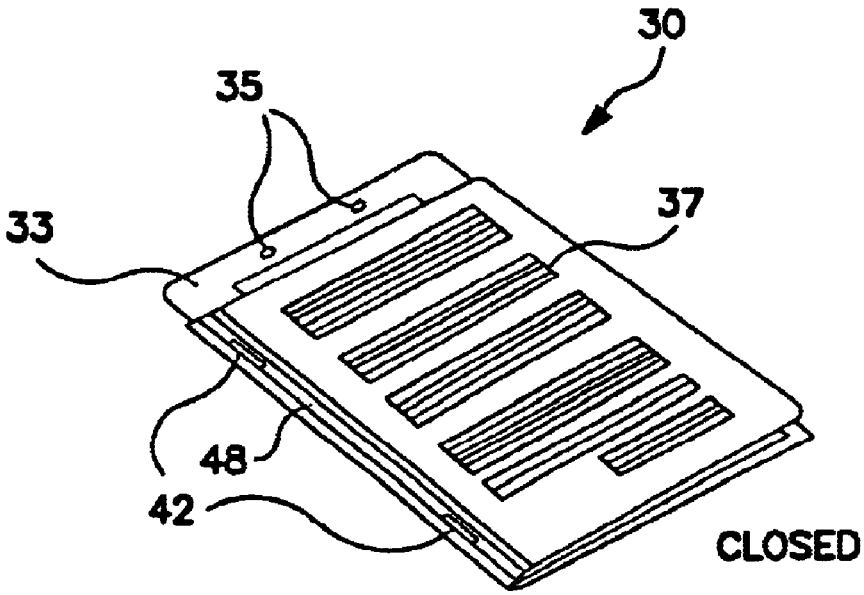
FIG. 12 depicts the cover of FIG. 11 with the document fixed in it as a result of stapling through the creased score portion, through the document, and through the cover.

FIG. 12 depicts the cover of FIG. 11 with the document fixed or stapled in through the crease score portion 48 (which is folded to cover the left edge of document 37), through the document 37, and through the panel 31 of cover 30. The identifying data entered in space 36 on extension 33 located at the top of cover 30 can be seen. Document 37 is fixed or stapled into cover 30 by staples 42 inserted through the creased score portion 48, the left side of document 37, and the left side of panel 31.

Figure 13:
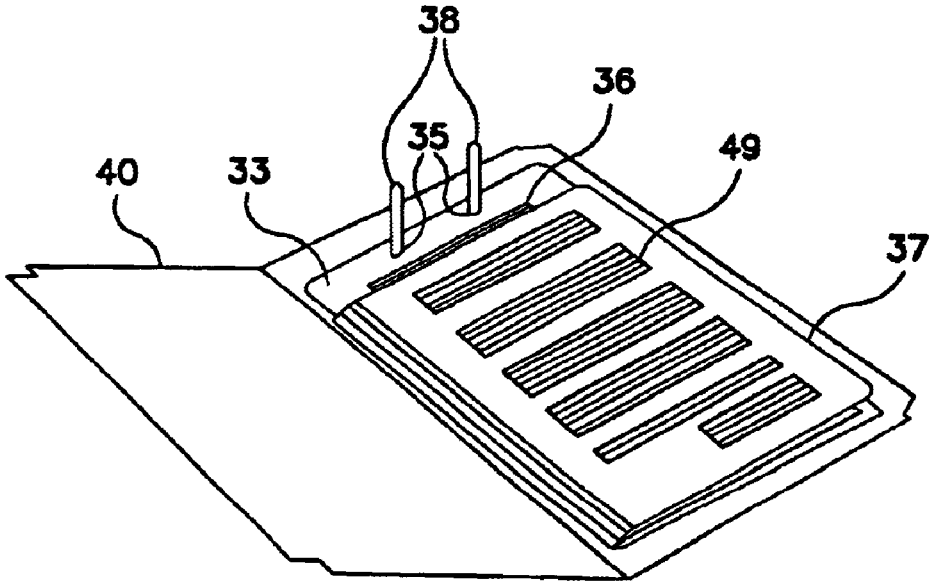
FIG. 13 depicts the cover of FIG. 12, with the document fixed or stapled into the cover, and the cover inserted into a standard file folder.

FIG. 13 depicts the cover of FIG. 12, with the document fixed or stapled into the cover, and the cover inserted into a standard file folder. File folder 40 has holes (not shown) in the upper portion of its panel, the holes coinciding with clip holes 35 provided in extension 33 of cover 30. Clips 38 are inserted through the holes in file folder 40, and the cover 30 (with document 37 stapled into it) is mounted in file folder 40 by passing clips 38 through the clip holes 35 of cover 30.

Figure 14:
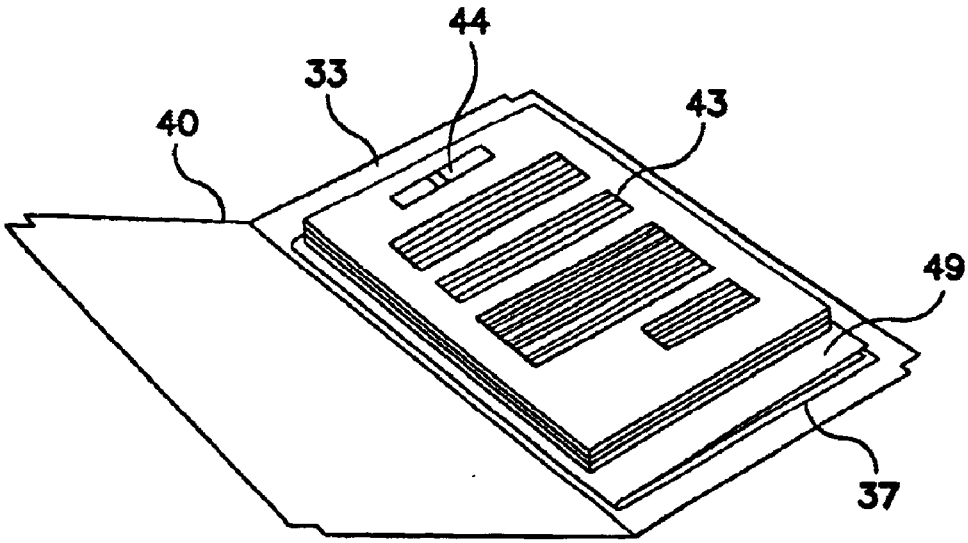
FIG. 14 depicts the file folder of FIG. 13 in the open position, with the document cover and attached document clipped into the folder, and with other material clipped into the folder on top of the document and the cover.

FIG. 14 depicts the file folder of FIG. 13 in the open position, with the document cover and the attached document clipped into the folder, and with other material clipped into the folder on top of the document and cover. Once the document cover 30 is positioned in the file folder 40 via clips 38, additional material 43 can be secured in file folder 40 by placing it on top of cover 30. In accordance with the invention, it is presumed that the additional material 43 is previously punched so as to have holes at the top thereof, the latter holes coinciding with the clips 38. The additional material 43 is positioned in file folder 40 by passing the clips 38 through the holes in the additional material 43. Then, the cover 30 and additional material 43 are fixed in the file folder 40 by securing the clips 38 via a conventional fastener, e.g., the clasp 44 shown in FIG. 14.

Figure 15:
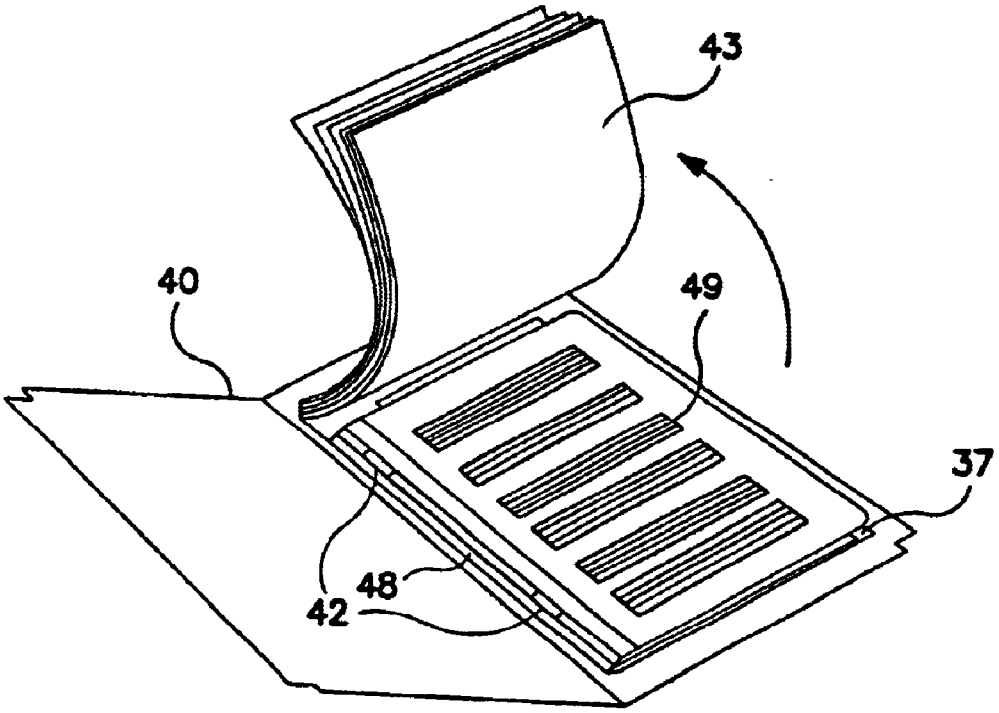
FIG. 15 depicts the file folder of FIG. 14 with the document cover and the attached document clipped into it, with other material clipped on top of the document and cover, and with the other material rolled back to expose the document in the document cover for review or reading of the both the front and the back of the pages of the document.
Figure 16:
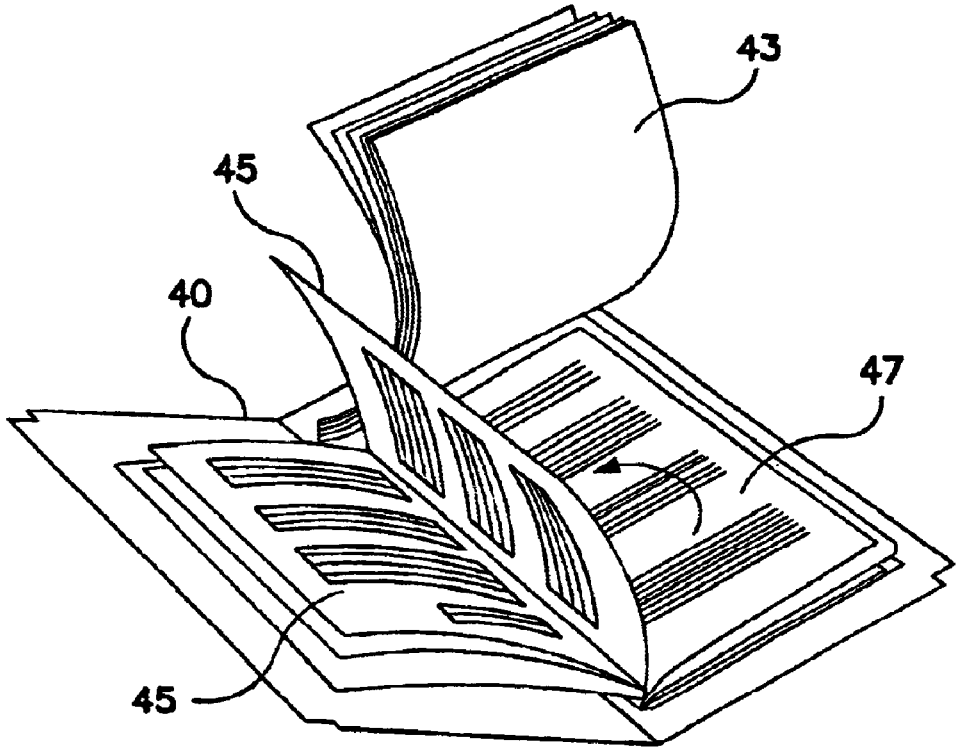
FIG. 16 depicts the file folder of FIG. 15 with the document cover and the attached document clipped into it, with the other material rolled back, and with the pages of the document being turned in a manner similar to reading a book.

FIG. 15 depicts the file folder of FIG. 14 with the document cover and the attached document clipped into it, with other material clipped on top of the document and cover, and with the other material rolled back to expose the document in the document cover for review or reading of the both the front and the back of the pages of the document, while FIG. 16 depicts the file folder of FIG. 15 with the document cover and the attached document clipped into it, with the other material rolled back, and with the pages of the document being turned in a manner similar to reading a book. When a person desires to review the document 37 in cover 30, the additional material 43 is rolled back, the cover 30 is opened, and the document 37 is reviewed. As seen in FIG. 16, a specific page 47 of document 37 can be reviewed by turning pages 45 of document 37 in the same manner as one turns pages when reading a book.

To summarize, the cover 30 covers the back of document 37. The cover 30 has extension 33 at the top so that the cover 30 and attached document 37 can be clipped into the file folder 40, as depicted in FIGS. 13 and 14. The cover 30 preferably has sufficient crease scores 48 on the left hand side to accommodate a document of up to five eighths inch (⅝") thick, and to permit stapling of the document 37 and the cover 30 through crease scores 48 (see FIGS. 13 and 14).

Both embodiments of the invention permit the document inserted into the cover to be read like a book, even when additional material is inserted on top of the document to be read. Preferably, the cover, whether a front and back style cover or a back only cover, has a width of only eight and five-eighths inches (8⅝"). While the figures show that the document covers are only twelve and one-half inches (12½") from top to bottom, they can be of any length, to include "legal length" documents. Normal legal size files are approximately 14¾ inches, and the proposed cover can be made of that same length to hold legal length documents. For letter size documents the cover would fit a file folder of 12½". The documents and covers for a file folder shorter than 12½" can be used by reducing the length of the back cover extension. Thus, the present disclosure should not be construed as limiting the lengths of the document covers, since they can be of any length.

It should be noted that, with each of the disclosed embodiments, there is space provided at the top of the cover to put in firm names, client names, document title, file number, case number, date, etc.(in the center, both above and below the file clips, and on either side of the file clips). In addition, in the first embodiment (the "front and back" cover), adequate space is provided on the front cover to place such data. In addition, in the second embodiment (the "back only" cover), all of the foregoing data may be printed on the first page of the document so as to be clearly visible.

The covers can be made from any color of material. Traditionally, blue or white is used for commercial transactions. However, courts require several colors; for example, in appellate courts, the appellant uses blue, the respondent uses red, and interveners or amicus curiae use green, while the reply brief is grey, and the front cover of an appendix ( if separately printed) is white.

The covers can be made in any weight of material. Traditionally, the covers have been made of 24 pound material, but they can be of heavier or lighter material at the option of the user or as regulations may require.

Most documents have one-inch margins on the left, and the covers of the present invention will accommodate that without covering up any material. Of course, the margins at the top and bottom of the document can be as narrow as desired. However, due to the ease with which all pages of the document can be read, normal (10 inch) margins will suffice.

While preferred forms and arrangements have been shown in illustrating the invention, it is to be understood that various changes and modifications may be made without departing from the spirit and scope of this disclosure.

What is claimed is:

1. A document cover for holding a document, comprising:

a flat panel;

a top extension formed by a top portion of said flat panel; and a crease score portion connected to a side of said flat panel;

wherein said crease score portion has a plurality of score lines formed therein;

wherein, when the document is positioned on said flat panel, said crease score portion is folded along only one of said score lines so that at least a portion of said flat side extension crease score portion lies substantially flat over the side of the document and all of said flat side extension crease score portion lies parallel to said flat panel and the document held by said document cover, and wherein the document is fixed to said flat panel by staples inserted through said crease score portion, the side of the document and said flat panel; and wherein said top extension has clip holes formed therein for receiving clips, said clips being passed through corresponding holes in a file folder prior to passing through said clip holes in said top extension, said clips being fastened by a fastener so as to attach said document cover, and the document held by said document cover, to said file folder.

2. The document cover of claim 1, wherein space is provided on said top extension and adjacent to said clip holes for inserting information identifying at least one of the document and the file folder.

3. The document cover of claim 1, wherein said flat panel and said top extension together have a height greater than a height of said crease score portion.

4. The document cover of claim 1, wherein said flat panel and said crease score portion together have a width greater than a width of the document fixed to said flat panel.

5. The document cover of claim 1, wherein said flat panel comprises a rear panel of said document cover, said document cover further comprising a front panel connected to said rear panel via said crease score portion.

6. The document cover of claim 5, wherein said flat panel and said top extension together have a height greater than a height of said crease score portion.

7. The document cover of claim 5, wherein said flat panel and said crease score portion together have a width greater than a width of the document fixed to said flat panel.

8. The document cover of claim 5, wherein said front panel contains space, on a side of said front panel remote from said rear panel, for inserting at least one of information identifying the document and other data.

9. A document cover, for holding a document, comprising:

a flat panel:

a top extension formed by a top portion of said flat panel; and a crease score portion connected to a side of said flat panel;

wherein said crease score portion has a plurality of score lines formed therein;

wherein, when the document is positioned on said flat panel, said crease score portion is folded along only one of said score lines so that at least a portion of said crease score portion lies substantially flat over a side of the document and all of said crease score portion lies parallel to said flat panel and the document held by said document cover, and wherein the document is fixed to said flat panel by staples inserted through said crease score portion, the side of the document and said flat panel;

wherein said flat panel comprises a rear panel of said document cover, said document cover further comprising a front panel connected to said rear panel via said crease score portion; and wherein said top extension has clip holes formed therein for attaching said document cover to a file folder, and space is provided on said top extension and adjacent to said clip holes for inserting information identifying at least one of the document and the file folder.

10. The document cover of claim 9, wherein said flat panel and said top extension together have a height greater than a height of said crease score portion, and wherein said flat panel and said crease score portion together have a width greater than a width of the document fixed to said flat panel.

11. A document cover for holding a document, comprising:

a flat panel;

a top extension formed by a top portion of said flat panel; and a crease score portion connected to a side portion of said flat panel;

wherein said top extension has clip holes formed therein for receiving clips, said clips being passed through corresponding holes in a file folder prior to passing through said clip holes in said top extension, said clips being fastened by a fastener so as to attach said document cover, and the document held by said document cover, to the file folder.

12. The document cover of claim 11, wherein said crease score portion has a plurality of score lines formed therein; and wherein, when the document is positioned on said flat panel, said crease score portion is folded along only one of said score lines so that at least a portion of said crease score portion lies substantially flat over a side of the document and all of said crease score portion lies parallel to said flat panel and the document held by said document cover, and the document is fixed to said flat panel by staples inserted through said crease score portion, the side of the document and said flat panel.

13. The document cover of claim 11, wherein space is provided on said top extension and adjacent to said clip holes for inserting information identifying at least one of the document and the file folder.

14. The document cover of claim 11, wherein said flat panel and said top extension together have a height greater than a height of said crease score portion.

15. The document cover of claim 11, wherein said flat panel and said crease score portion together have a width greater than a width of the document fixed to said flat panel.

16. The document cover of claim 11, wherein said flat panel comprises a rear panel of said document cover, said document cover further comprising a front panel connected to said rear panel via said crease score portion.

17. The document cover of claim 16, wherein space is provided on said top extension and adjacent to said clip holes for inserting information identifying at least one of the document and the file folder.

18. The document cover of claim 16, wherein said flat panel and said top extension together have a height greater than a height of said crease score portion.

19. The document cover of claim 16, wherein said flat panel and said crease score portion together have a width greater than a width of the document fixed to said flat panel.

20. The document cover of claim 16, wherein said front panel contains space, on a side of said front panel remote from said rear panel, for inserting at least one of information identifying the document, information identifying the file folder, and other data.

* * * * *

UNITED STATES PATENT AND TRADEMARK OFFICE

CERTIFICATE OF CORRECTION

PATENT NO. : 6,742,810 B2
DATED : June 1, 2004
INVENTOR(S) : Vaughan

It is certified that error appears in the above-identified patent and that said Letters Patent is hereby corrected as shown below:

Column 7,
Lines 11 and 13, delete “flat”
Lines 12 and 14, delete “side extension”

Signed and Sealed this

Tenth Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,742,810 B2
DATED : June 1, 2004
INVENTOR(S) : Vaughan

It is certified that error appears in the above-identified patent and that said Letters Patent is hereby corrected as shown below:

Column 7,
Lines 16 and 18, delete "flat"
Lines 17 and 19, delete "side extension"

This certificate supersedes Certificate of Correction issued August 10, 2004.

Signed and Sealed this

Twenty-eighth Day of December, 2004

JON W. DUDAS
*Director of the United States Patent and Trademark Office*